US008429853B2

(12) United States Patent
Martin

(10) Patent No.: US 8,429,853 B2
(45) Date of Patent: Apr. 30, 2013

(54) POCKET DOOR FOR A BOAT

(76) Inventor: Garret Martin, Newport Beach, CA (US)

( * ) Notice: Subject to any disclaimer, the term of this patent is extended or adjusted under 35 U.S.C. 154(b) by 1021 days.

(21) Appl. No.: 11/850,571

(22) Filed: Sep. 5, 2007

(65) Prior Publication Data

US 2007/0295257 A1 Dec. 27, 2007

Related U.S. Application Data

(62) Division of application No. 11/185,580, filed on Sep. 15, 2005.

(51) Int. Cl.
*E06B 3/34* (2006.01)

(52) U.S. Cl.
USPC ..... 49/41; 49/404; 49/370; 49/323

(58) Field of Classification Search ..... 49/41, 116, 49/118, 117, 425, 323, 360, 404, 370, 501
See application file for complete search history.

(56) References Cited

U.S. PATENT DOCUMENTS 3,136,538 A * 6/1964 Kessner et al. ..... 49/117
3,979,872 A * 9/1976 Gilchrist et al. ..... 52/784.15
4,304,071 A * 12/1981 Obrecht ..... 49/26
5,675,946 A * 10/1997 Verbeek et al. ..... 52/205

* cited by examiner

*Primary Examiner* — Jerry Redman
(74) *Attorney, Agent, or Firm* — Hani Z. Sayed; Ruatan & Tucker, LLP

(57) ABSTRACT

A boat has an outside pocket door that opens to provide a passageway large enough for a person to pass. Of particular interest are sliding doors that utilize a traveler and a guide, each positioned on one of the door and the housing, having tolerances that severely restrict side to side movement of a distal edge of the door under normal operating conditions. The guide can advantageously comprise a track and rollers, and the traveler can comprises a foot disposed to travel between opposing ones of the rollers. In such embodiments the rollers can advantageously be mounted in spaced apart opposing pairs on a guide, using off-set centers to adjust the tolerances. Sliding doors can be operated in any suitable manner, manually or otherwise, and it is especially contemplated that sliding doors can be operated using a pneumatic ram.

18 Claims, 3 Drawing Sheets

FIG. 4
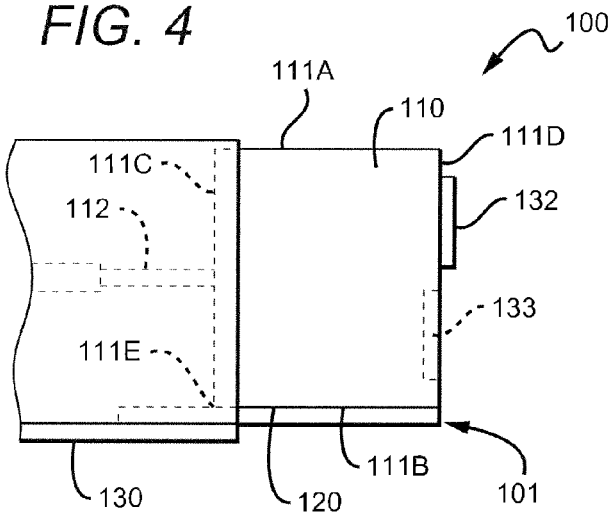
FIG. 6
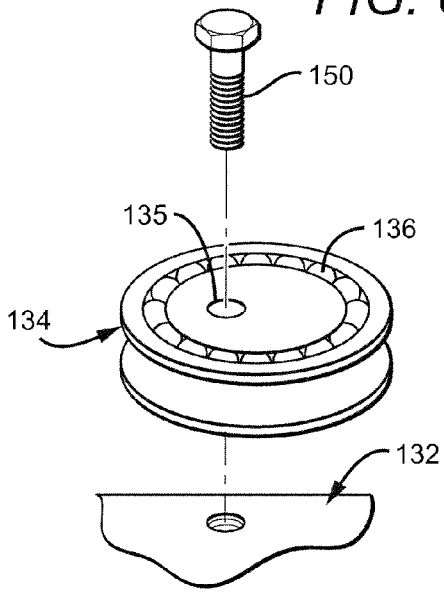
FIG. 5
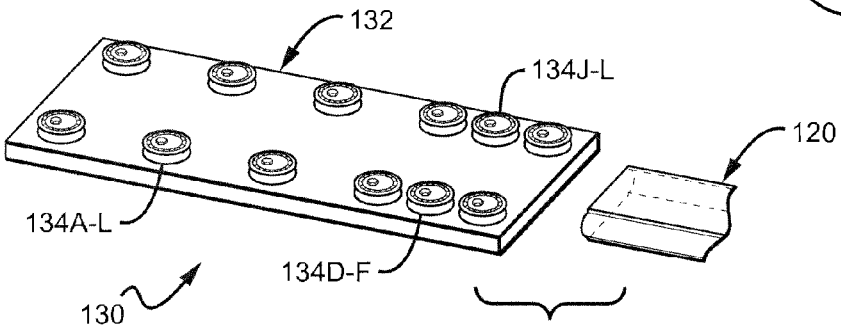
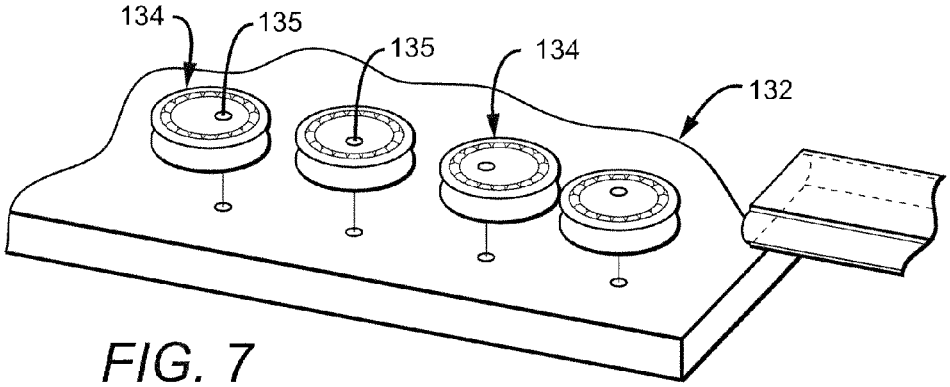
FIG. 7

POCKET DOOR FOR A BOAT

PRIORITY

This application is a divisional to the prior filed parent application U.S. patent Ser. No.: 11/185,580 filed on Sep. 15, 2005.

FIELD OF THE INVENTION

The field of the invention is boating construction.

BACKGROUND

Many different types of sliding doors are known. Such doors are very commonly supported by an overhead track and roller system, and can also have a guiding track underneath. The bottom track usually runs the length of the path of the door, and constrains undesired lateral movement of the door.

Pocket doors are sliding doors in which at least a portion of the door is withdrawn into an enclosure. Such doors are well-known in residential housing and offices, and have also been used in boats where a swinging door is undesirable, and space is at a premium. Pocket doors are usually straight, but it is known to use curved pocket doors in corner cabinets, furniture and the like.

A transom is a transverse panel forming the aft end of a boat's hull. Transoms commonly extend up above the boat's deck by a meter or more, and often have an opening through which a person can enter or exit the boat. Such openings can be blocked off with a solid door, chain, or other deterrent, but the known devices for accomplishing that function are sometimes undesirable. Regular swinging doors, for example, require adequate space for movement. And, when swung open unexpectedly, such doors can injure a person standing in its way.

Known pocket doors could theoretically be used for a boat transom, or in some other external positions on a boat, but they would not work properly. For one thing known pocket doors are usually hung from above, and therefore require some sort of stabilizing track running the length of the path of the door. But a track crossing the opening of a boat transom would be undesirable because it would be unsightly, it would tend to fill with water and other debris, and it could even comprise a danger because it could catch clothing or other objects. Problems are exacerbated for boats having a door in a curved transom. Such doors would have to be curved as well, which would be especially hard to implement without a track running across the opening.

It should be possible to support a pocket door without using a bottom track running the length of the path of the door. But one of ordinary skill in the art would reject the idea of using a pocket door in a boat because, unlike the usual housing, cabinet or furniture implementations, there will almost certainly be very significant lateral forces placed upon the boat door from time to time. Without the underlying track, the door would very likely be pushed side to side, out from its intended path.

Thus, there is still a need for a boat with a transom having an exterior portion, which includes a pocket door that opens to provide a passageway large enough for a person to pass.

SUMMARY OF THE INVENTION

The present invention provides apparatus, systems and methods in which a boat has an exterior portion, which includes a pocket door that opens to provide a passageway large enough for a person to pass.

The door can be anywhere on the exterior of the boat; for example along the transom, along a side of the boat, or leading into the cabin. Of particular interest are sliding doors that utilize a traveler and a guide, each positioned on one of the door and the housing, and having tolerances that restrict side to side movement of a distal edge of the door under normal operating conditions to 5 cm or less, more preferably to 2 cm or less, and most preferably to 5 mm or less. In a particularly preferred embodiment, the guide comprises a track and rollers, and the traveler comprises a foot disposed to travel between opposite rollers. In such embodiments the rollers can advantageously be mounted in spaced apart opposing pairs on a guide, and appropriate tolerances can be set using off-center axes in the rollers.

Travelers and guides can be made of any suitably rigid material or materials, including for example, steel or other metal alloy. Preferred travelers extend beyond the inside edge (the trailing edge that remains within the housing) of the door by at least 5 cm, and more preferably at least 20 cm. Since a major function of the traveler is to prevent side to side movement of the sliding door, preferred travelers also have a width of at least 2 cm, and more preferably at least 4 cm. Travelers can be in the form of a foot, a piston ram, or any other suitable shape, but as used herein the term traveler means a separate element from the body of the door. Thus, the term traveler excludes an unmodified bottom portion of the door, such as one would find in a typical home closet. The guide is also preferably not visible from outside the housing.

Contemplated sliding doors can be virtually any size or shape, and can include any suitable material or combination of materials. Preferred doors are at least one meter long, 5-10 cm side, and 0.5 to 1.5 meters tall. For boats, sliding doors are preferably manufactured from fiberglass or other waterproof polymeric material(s). Sliding doors can be used in pairs, where the sliding doors approximate one another at their leading edges. One or more detents can be placed on a leading edge of one or more doors, possibly with corresponding indentations in an approximating surface. Sliding doors are contemplated to be straight or curved.

Sliding doors can be operated in any suitable manner, manually or otherwise, and it is especially contemplated that sliding doors can be operated using a pneumatic ram.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 4 is schematic illustration of a transom door with sliding mechanism.

FIG. 5 is a view of the track and rollers assembly.

FIG. 6 is a view of a roller with off-center axis.

FIG. 7 is a view of rollers with off-center axes allowing positional adjustment during installation.

DETAILED DESCRIPTION

Figure 1:
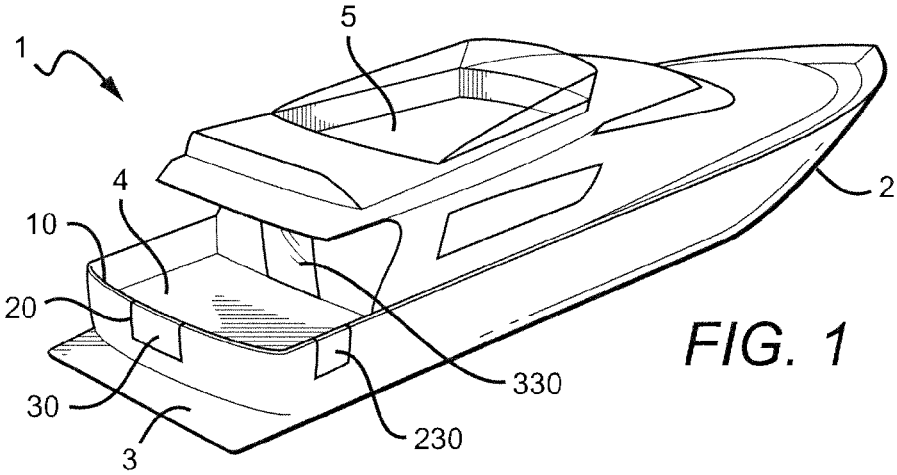
FIG. 1 is an aerial aft perspective view of a boat having a three pocket doors.
Figure 2:
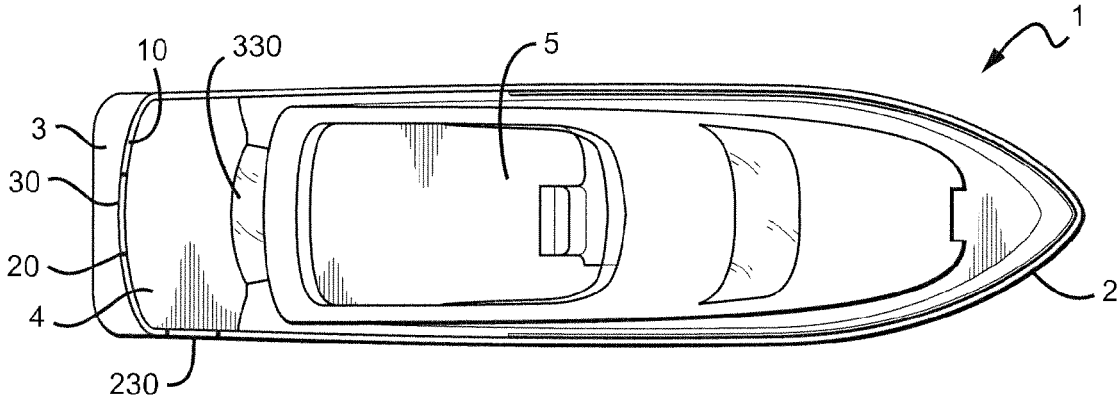
FIG. 2 is a top view of the boat of FIG. 1.

In FIGS. 1 and 2, a boat 1 generally has a bow 2, a stern 3, a deck 4, a cabin or cockpit 5, and a transom 10. Here, boat 1 has an opening 20 and a curved sliding transom door 30. A second, flat, sliding door 230 is shown on the starboard side of the boat, and a third sliding door 330, having an extremely slight curvature, is shown at the entrance to the cabin of the boat.

Boat 1 can be made of any suitable materials, including especially fiberglass, wood, metal, or combinations of such materials. All types of boats are contemplated, including, for example, those propelled by a motor, a sail, or both, as well as commercial, recreational, fishing/gaming, or any other type of boat.

A boat can have one or any realistic plural number of pocket doors, and such doors can be positioned anywhere on the boat, inside or outside the cabin. Nevertheless, it is especially contemplated that pocket doors can advantageously be positioned external to the cabin or at an entrance to the cabin. All suitable widths are contemplated for the openings created by the pocket door(s), including anywhere from about 50 cm to up to two meters or more. It is especially contemplated that openings can be large enough for a normal 70 kg adult person to pass through.

Figure 3:
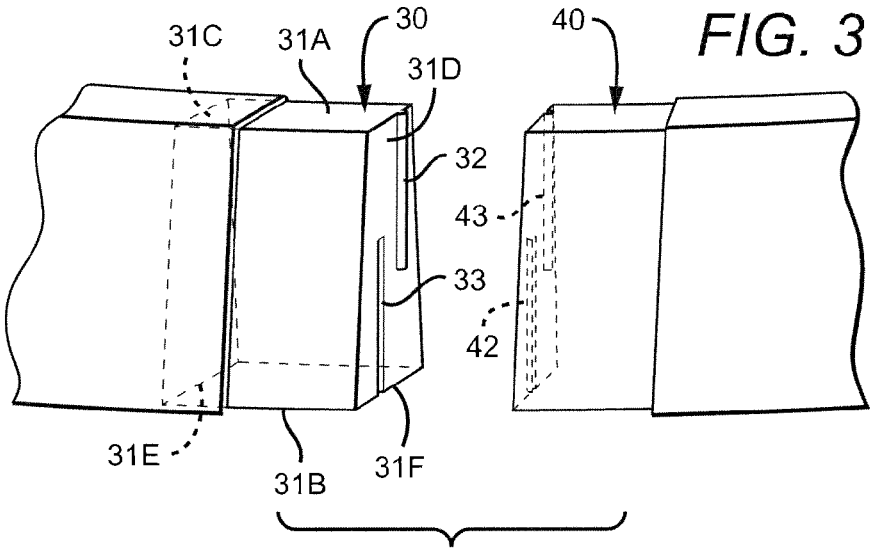
FIG. 3 is a view of a transom with double sliding doors.

FIG. 3 depicts two sliding doors 30, 40. Sliding doors 30 and 40 cooperate to open and close an opening (i.e. a passageway) between them, are together can comprise sliding door designated 330. Sliding door 30 generally includes top 31A, bottom 31B, proximal side 31C, distal side 31D, an inside edge 31E, and an outside edge 31F. Distal side 31D has elongated detents 32, 33 and corresponding indentations 43, 42 in an opposing surface. Detent 32 and indentation 33 can be constructed as part of the distal side 31D, or they can be constructed separately as attachments to distal side 31D. Detents 32, 33 can be made of any suitable materials, including, for example, rubber, fiberglass, plastic, metal, wood and so forth.

Use of two elongated detents in the approximate orientations shown is considered to be especially desirable because they can block light from passing in a space between the sliding door and the abutting surface, which in this instance is sliding door 40. As used herein, the term "approximates" includes all situations where the approximating surfaces come to within 1 cm of one another, and specifically includes situations where the approximating surfaces touch one another. Those skilled in the art will, of course, appreciate that alternative detents can be different in number, configuration and orientation from that shown, including for example one or more finger-like projections extending normally from, rather than vertically to, the outside edge.

Sliding door 30 (and also 230, 330) can be made of any suitable material, including for example, fiberglass, wood, metal, and so forth. Sliding doors can be solid or hollow, and can have any suitable configuration. Sliding doors can be flat, or alternatively bowed horizontally, vertically or in some other manner. They can also be curved or non-curved. All practical curvatures are contemplated, including especially those having a radius of curvature less than 10 meters, between 10 and 20 meters, and greater than 20 meters. Contemplated doors can also be curved in some manner that is inconsistent with a single radius.

Opening 20 is closed off by a single-door panel unit as shown in FIGS. 1 and 2. In the alternative, an opening can be closed by two transom sliding doors, as shown in FIG. 3. The two doors would usually be mirrors of one another, but they can alternatively have different configurations.

FIGS. 4-7 illustrate schematically the sliding door assembly 100, which generally comprises a sliding door 110, a traveler 120, a guide 130. Here, the traveler 120 comprises a foot, and the guide 130 comprises a race.

Sliding door 110 can be similar to door 30, 230 or 330, and generally includes a top 111 A, a bottom 111B, a side 111C, a leading edge 111D, and a trailing edge 111E. The door 110 can be solid, hollow, have internally molded baffles, or have any other suitable configuration. Leading edge 111D is shown as having a detent 132 and an indentation 133, which mate with opposing structures (not shown). The detent 132 can be constructed using any suitable materials.

Sliding mechanism 101 comprises a foot 120 and a guide 130. In FIG. 4 a series of roller pairs constrains movement of the foot 120 within the guide 130, but it should be appreciated that any other suitable system can be used, including for example one or more rails disposed on the guide, upon which travels the foot or a channel formed underside of the door. It is especially contemplated that the weight of the sliding door 110 can be entirely supported by the traveler, which in this case is the single foot 120. To that end the traveler is preferably screwed to the bottom and/or one or both sides of the sliding door. To provide adequate support when the door is in a closed position, the traveler preferably extends outward beyond the inside edge of the sliding door by at least 10 cm, and more preferably by 20 cm, 40 cm, or more. This extended portion of the traveler provides continued engagement with a corresponding guide even when the sliding door is fully extended.

The sliding mechanism 101 can have any suitable position or orientation. In FIG. 4 the mechanism 101 is positioned at the bottom of the sliding door 110. But it should be appreciated that a sliding mechanism could be additionally or alternatively positioned on the top or one or both sides of the door. It is also contemplated that instead of a foot and a race, the sliding mechanism can comprise a piston and ram, or even a hanger arrangement, so long as the tolerances of the mechanism restrict the side to side movement of the distal (i.e. leading) edge of the door under normal operating conditions to less than 5 cm, more preferably to less than 2 cm, still more to preferably less than 1 cm, and most preferably to less than 5 mm.

In more general terms it is contemplated that the traveler and guide can each be positioned on one of the door and the housing. Thus, the traveler could be on the door and the guide on the housing, or visa versa. Indeed, there could even one or more travelers on each of the door and the housing, and one or more mating guides on each of the door and housing. It should also be appreciated that different sliding mechanisms can be used for different doors of a pair.

The traveler and/or guide can be made with any suitable material, but preferably stainless steel or other corrosion resistant alloy, or a reinforced synthetic material that provides sufficient strength.

Optional actuator 112 automatically closes and opens sliding door 110. A pneumatically operated ram is preferred because it eliminates electrical connections in a potentially moist area, and can take advantage of pressurized air which is commonly available on larger boats. It is, however, contemplated that an electric, hydraulic or other type of ram could be used. Of course, door 110 could also be operated manually.

In FIG. 5, race 130 generally includes a frame 132 upon which are disposed rollers 134A-L. Frame 132 can be made of suitably strong and durable material such as metal, synthetic material, and wood. Rollers 134A-L constrain lateral movement of foot 120 while allowing for longitudinal movement. Rollers can be arranged in any suitable arrangement, but to provide greater stability when the door is closed, more proximal pairs of rollers 134D-F and 134J-L are spaced closer together on frame 132 than more distal pairs of rollers 134A-L. Although FIG. 5 shows that individual members of a given pair of rollers as always positioned opposite one another, the rollers can be staggered such that there are no pairs, or so that the rollers are positioned in some other configuration. Rollers are preferably rotatable, usually about an inner guide with bearings, but could have any other suitable design, including being non-rotatable.

In FIGS. 5-7, the rollers advantageously have a bodies with off-center holes. In FIG. 6, for example, roller 134 has off-center hole 135, which receives a bolt or other fastener 150. By turning the body about the fastener, and then tightening the roller to the frame 132, an installer can make minor adjustments to the relative position of the various rollers to the foot. As illustrated in FIG. 7, positional movement of roller 134 not only allows adjustment and readjustment to provide desired tollerances between foot 120 and guide 130, it also allows more convenient placement of foot 120 between the two rows of rollers 134A-L. As discussed above, roller 134 preferably includes bearings 136.

Figure 8:
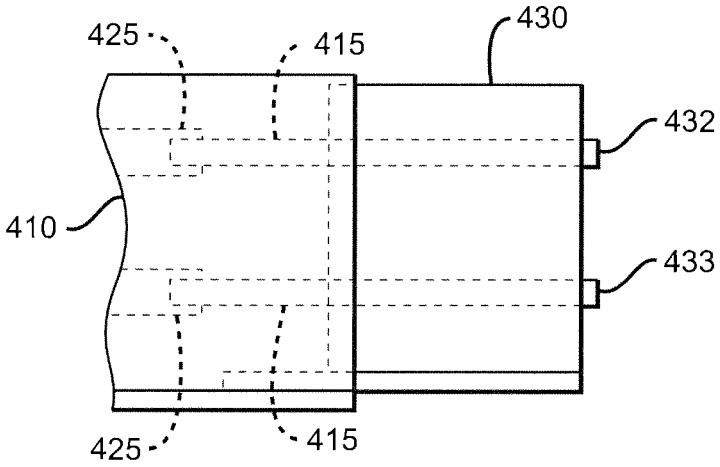
FIG. 8 is a partially transparent side view of a sliding door having a ram type traveler.

In FIG. 8, a door 430 slides into and out from a housing 410. There are two cylindrically shaped travelers 415 that cooperate with cylinders 425 to support the weight of door 430, while allowing door 410 to move laterally in either direction without excessive side to side movement. In this particular instances, detents 432, 433 are finger like projections that have a long axis extending horizontally, in contrast to the detents 32, 33 of FIG. 3 that have a long axis extending more or less vertically.

Thus, specific embodiments and applications of pocket sliding door have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps can be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A sliding door assembly for a boat, the assembly comprising:

a transom portion of a boat whereby the transom has an exterior portion having a first sliding door and whereby the transom has a housing, the exterior portion having an opening large enough for a person to walk through;

the first sliding door slides into and out from the opening into the housing contained within the transom whereby the first sliding door has at least a detent; and a traveler and a guide provided to be used as a sliding mechanism, each positioned on one of the door and the housing, the traveler and guide cooperating and having tolerances that restrict side to side movement of a distal edge of the door under normal operating conditions to no more than 5 cm and further wherein the guide comprises a track and rollers, and the traveler comprises a foot disposed to travel between opposite rollers.

2. The assembly of claim 1 wherein the traveler extends beyond an inside edge at the door by at least 5 cm.

3. The assembly of claim 1 wherein the traveler extends beyond an inside edge at the door by at least 20 cm.

4. The assembly of claim 1 wherein the traveler has a width of at least 2 cm.

5. The assembly of claim 1 wherein the traveler has a width of at least 4 cm.

6. The assembly of claim 1 wherein the tolerances restrict the side to side movement of the distal edge of the door under normal operating conditions to no more than 1 cm.

7. The assembly of claim 1 wherein the door comprises fiberglass.

8. The assembly of claim 1 further comprising first and second overlapping elongated detents disposed on a leading edge of the door.

9. The assembly of claim 1 wherein the door has a weight, and the weight of the door is entirely supported by the traveler.

10. The assembly of claim 1 wherein the guide comprises a track and rollers and the traveler comprises a foot disposed to travel between opposing ones of the rollers.

11. The assembly of claim 1 wherein the guide comprises a roller that has an off-center axis.

12. The assembly of claim 1 wherein the guide comprises a plurality of opposing pairs of rollers.

13. The assembly of claim 1 wherein the guide comprises opposing pairs of rollers that are unevenly distributed along a length of the guide.

14. The assembly of claim 1 wherein the door has no substantial curvature.

15. The assembly of claim 1 wherein the door is curved with a radius of less than 10 meters.

16. The assembly of claim 1 further comprising a second sliding door that mates with the first sliding door.

17. The assembly of claim 1 further comprising a pneumatically operated ram that moves the first sliding door.

18. The assembly of claim 1 wherein the guide is not visible from outside the housing.

* * * * *